United States Patent [19]

Lindner et al.

[11] 4,237,758

[45] Dec. 9, 1980

[54] PROCESS AND APPARATUS FOR SHREDDING FIBRE TOWS INTO STAPLE FIBRES

[75] Inventors: Wolfgang Lindner; Herbert Lütkecosmann, both of Dormagen, Fed. Rep. of Germany

[73] Assignee: Bayer Aktiengesellschaft, Leverkusen, Fed. Rep. of Germany

[21] Appl. No.: 960,815

[22] Filed: Nov. 15, 1978

[30] Foreign Application Priority Data

Nov. 22, 1977 [DE] Fed. Rep. of Germany ..... 2752068

[51] Int. Cl.[3] ..... D01G 1/04

[52] U.S. Cl. ..... 83/403; 83/346; 83/913; 83/411 R; 83/733

[58] Field of Search ..... 83/913, 346, 403, 733, 83/411 R, 37, 856

[56] References Cited

U.S. PATENT DOCUMENTS

| | | | |
|---|---|---|---|
| 3,485,120 | 12/1969 | Keith | 83/346 X |
| 3,744,361 | 7/1973 | Van Doorn et al. | 83/346 X |
| 3,768,355 | 10/1973 | Farmer et al. | 83/403 |
| 3,861,257 | 1/1975 | Laird et al. | 83/346 X |
| 3,915,042 | 10/1975 | Laird | 83/346 X |

*Primary Examiner*—Donald R. Schran

*Attorney, Agent, or Firm*—Sprung, Felfe, Horn, Lynch & Kramer

[57] ABSTRACT

The shredding of fibres in the form of bands or strands to staple fibres with short staple length and fibre velocities of up to 6,000 m/min is attained by winding the fibre tow around a cutting ring with adjustable blades and cutting up the fibre tow by pressure rollers pressing radially on the winding. The feeding of the fibre tow is synchronized with the pressure rollers, as these rollers are fixed in supporting discs which rotate above and below the cutting ring with the same velocity as the depositing nozzle.

6 Claims, 6 Drawing Figures

FIG. 1
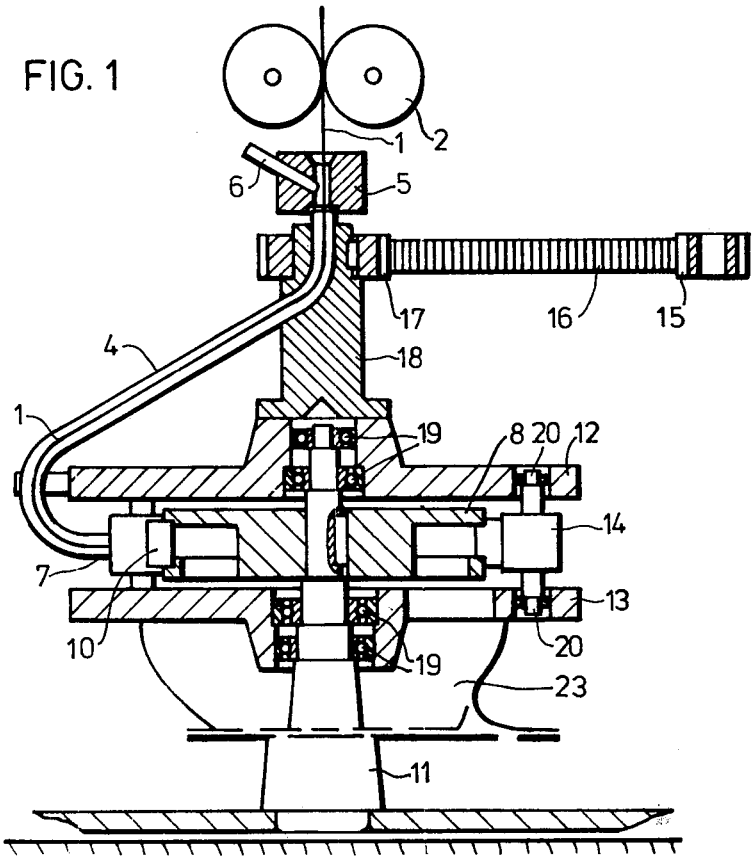
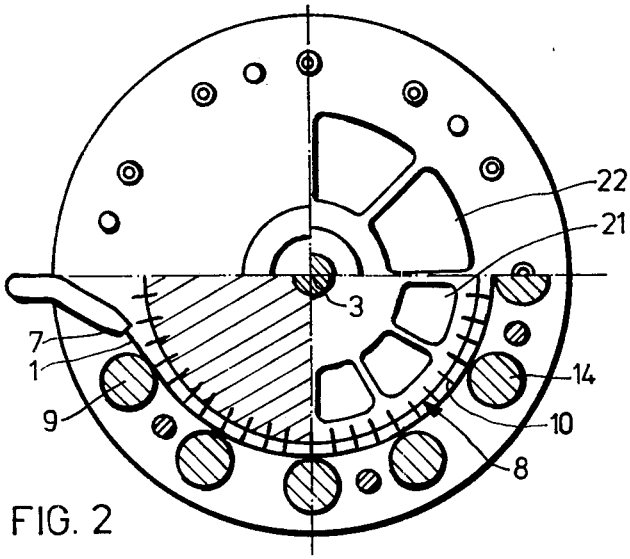
FIG. 2

FIG. 3
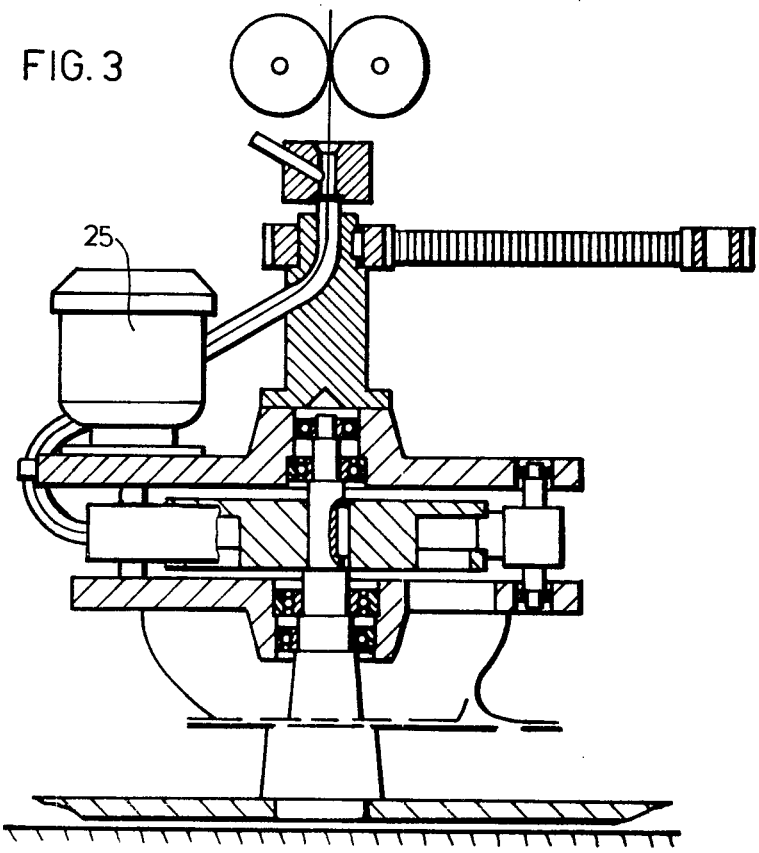
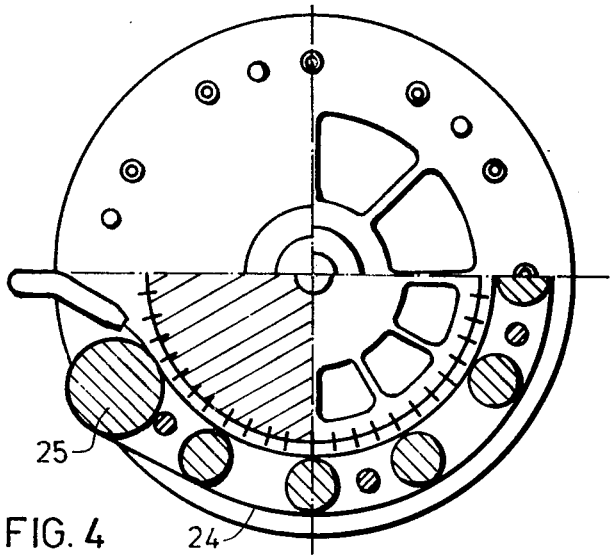
FIG. 4

PROCESS AND APPARATUS FOR SHREDDING FIBRE TOWS INTO STAPLE FIBRES

This invention relates to a process for shredding fibre tows into staple fibres, in which the tow is wound round a ring of knives having substantially radical blades and is shredded by pressure rollers acting radially on it from outside, and apparatus for carrying out the process.

Apparatus for shredding fibres in the form of bands or strands, in particular for the manufacture of staple fibres, has been described, for example, in German Offenlegungsschriften Nos. 1,660,286; 1,760,643; 2,400,471; 2,408,258 and 2,456,941. These apparatus are mainly cutting machines consisting of a rotating cutting ring comprising a plurality of exchangeable knives and a pressure roller which rotates with the cutting ring and presses the fibre bundle into the ring while the bundle is being wound on to the ring. There is a second group of cutting machines described, for example, in German Offenlegungsschriften Nos. 2,328,274; 2,405,474 and 2,442,967 which consist of a clamping device for the fibre tow which is to be shredded and slots which are arranged at intervals corresponding to the length of the staple fibre, with knives rotating through these slots and cutting up the fibre tow. These cutting machines can be employed at fibre velocities of from 100 to 250 m/min. One disadvantage of all these apparatus is that they are unsuitable for velocities of 3000 m/min and more.

A process and apparatus for cutting staple fibres which is said to be suitable for high fibre velocities has been described in German Offenlegungsschrift No. 25 54 578. The process is characterised in that a depositing device deposits the fibre tow which is to be cut on a horizontal cutting ring which rotates about a vertical axis while a rotating pressure roller arranged behind the depositing device presses the tow into the cutting ring. One disadvantage of this apparatus is that the two reel wheels of the depositing device do not take off the fibre tow by means of force or a form locking grip. An injector is normally provided to ensure that the tow will be taken off by the reel wheels but is not successful in this case because its stream of fluid makes neat deposition of the fibre tow on the rotating cutting ring very difficult. The initial stages of winding the fibre on the ring or feeding operation is also a problem. It requires a manipulation which entails a great risk of accident since the fibre tow must be guided with a gun between the depositing reel and the rotating cutting ring and over the ring in order that the reel wheels may grip the tows. The risk of accident is all the greater the higher the feeding speed employed. It is for this reason that the application speaks only of feeding speeds "of 100 m/min and more" but the speeds required for practical purposes are in the region of from 3000 to 6000 m/min. If the speed is reduced for the initial applying of the tow on the ring, this means that waste is produced from the time when the tow is first placed in position until the time at which the cutting apparatus resumes its normal operating speed. Another very serious disadvantage is the fact that the heavy cutting wheel rotates at a circumferential velocity equal to the tow take-off velocity. This puts a considerable strain on the bearings and the material of the apparatus at the high speeds employed. The problems may in some cases be confounded by the pressure roller not acting radially on the cutting wheel but directing its cutting force axially and, due to its situation at the circumference of the cutting wheel, exerting a tilting moment alternately on this wheel and on its shaft.

Furthermore, the rotating cutting wheel requires suitably designed holders for the cutting knives, capable of withstanding the centrifugal forces. Due to this fact, the fact that webs are required to connect the external rim of the cutting wheel, which holds the cutting knives on the outside and carries the frictional surface for the pressure roller, with the core of the cutting wheel, and that these webs must be present in the required number and thickness, there is a lower limit to the length of the cut product, which is certainly not suitable for short staple lengths. This means that such a high speed cutting machine is only suitable for the manufacture of a limited number of groups of products.

Another high speed cutting machine, manufactured by Fourne, is described in the journal "Chemiefasern textilindustrie" (1976), No. 12. In this apparatus, the fibre tow is said to be thrown into a spiral "at no matter how high a velocity" and is wound round or into a stationary tube during formation of the spiral, so that the linear velocity in the direction of the tow and in a direction perpendicular to the plane of the spiral is automatically reduced to zero. The resulting spiral bundle, which is initially held by a support, is then slowly moved along the wall of the support in the axial direction of the tow winding by a vibration device. The spiral packet thus formed is then guided so that it can be cut up into staple fibres transversely to the direction of the continuous fibre by rotating textile cutting machines. For this purpose, the tube which carries the spirals has slots corresponding to the staple fibre length so that the rotating cutting blades can enter the slots to cut up the spiral packet running over them. The disadvantage of this apparatus is that the shortness of the cut length is limited by the drive of the cutting wheels. Short staples of 12 or 6 mm cannot be obtained. Futhermore, due to the way in which the fibre tow is presented to the cutting wheels, it is impossible to prevent a certain random positioning of the heaped up tow windings, which adversely affects the uniformity of cutting lengths of the staple fibres. Another problem with this apparatus is that the rate of feed of the plug of tow immediately in front of the cutting wheels is difficult to keep constant since it is determined partly by the force acting on this piece of tow and partly by the resistance to transport. Since both these factors depend to a considerable extent on the packing density and the friction against the wall and moreover fluctuate with time in the same way as the height of the plug, the cutting performance is not satisfactory.

It is an object of the present invention to provide a process and apparatus for carrying out the process, in which the bundle of fibre tow can be cut up into staple fibres at high fibre velocities, i.e. in the region of up to 6000 m/min, without the disadvantages described above. The problem is solved by means of the process in which the fibre tow is deposited on a cutting ring by means of a rotating depositing nozzle and two supporting discs, one above and one below the cutting ring, rotate synchronously with this nozzle, and pressure rollers are mounted on these discs in such a manner that they roll on the fibre tow. The apparatus consists substantially of a fixed or rotatable cutting ring having substantially radially disposed blades and a plurality of pressure rollers, a feed device for introducing the fibre tow to be cut and a container for receiving the staple fibres, and it is characterized in that the pressure rollers are mounted in supporting discs, two supporting discs being provided, one above and one below the cutting ring, each rotatable about this ring, the feed device consists of a depositing nozzle rotating about the cutting ring, a synchronous drive is provided for the supporting discs and the depositing nozzle, and the nozzle and the pressure rollers are so arranged in relation to the supporting discs that the depositing nozzle is always situated in a gap between two pressure rollers.

Thus, for example, in a preferred embodiment the slot between the pressure rollers and the cutting knife is not constant in width over the whole circumference but, beginning at the pressure roller at the entrance, it decreases in width from one pressure roller to the next when viewed opposite to the sense of rotation. The advantages thereby achieved consist that, firstly, when the process is started, the entrance pressure roller easily catches the cable unassisted and introduces it into the cutting slot and, secondly, the cutting force is provided not by a single wheel but by several. The mounting means for the pressure rollers are thereby simplified, so that higher velocities are more easily permissible and at the same time the fibre tow is securely held on the cutting ring and therefore correctly transported by the nozzle. Accumulation of tow at the inlet to the slot on the entrance pressure roller, would immediately be transmitted back to the pressure nozzle and stop production. The thickness of the end of the slot, i.e. the distance between the cutting ring and the circumference of the last pressure roller immediately in front of the nozzle, is adjusted so that at least one full winding of fibre tow can be accomodated on the cutting ring between the knives and the pressure rollers and the final pressure roller will clamp these windings just sufficiently firmly without forcing them through the cutting ring.

The following advantages can be achieved by the process and apparatus according to the invention:

Fibre tows at high draw-off velocities, in particular in the range of from 3000 to 6000 m/min, can be cut up into staple fibres virtually troublefree.

The cut lengths of the staple fibres is limited in decreasing length only by the knife holder and can be very small (a few mm).

The wheel of the cutting ring may be robust in construction and the bearings and mounting means pose no problems.

The rotating supporting discs for the pressure rollers can easily be balanced in weight even if the mass of the pressure rollers is asymmetrically distributed. By a suitable arrangement, the cutting force can be distributed over the circumference of the cutting ring.

The depositing nozzle and supporting discs have a common drive.

The fibre tow is automatically gripped by the cutting device.

Winding can be started at the full take-off speed and no waste is produced; starting the winding entails no danger.

The injector air of the nozzle can be used in a ventilator to remove the staple fibres from the cutting apparatus.

The apparatus according to the invention is illustrated in the Figures and described by way of example below. In the drawings, FIG. 1 is an elevational view of a cutting machine according to the invention.

FIG. 2 is a plan view in four sectional planes.

FIG. 3 is an elevational view of a cutting machine in which an endless belt is looped around the pressure rollers and the rollers are driven by an electric motor.

FIG. 4 is a corresponding plan view in four sectional planes.

Figure 5:
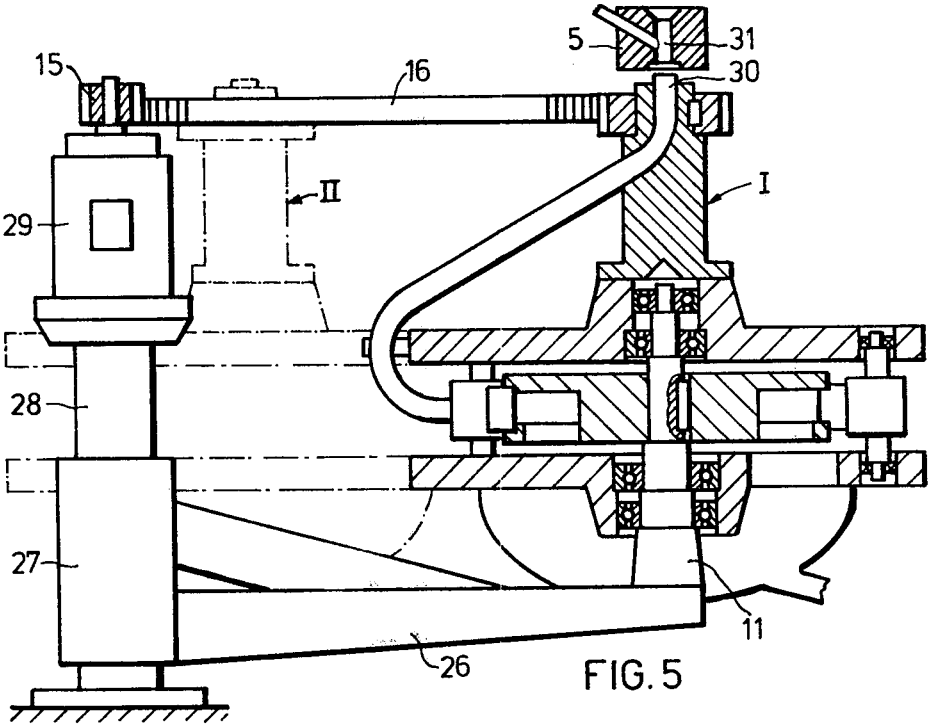
FIG. 5 is an elevational view of a cutting machine according to the invention equipped with two interchangeable blades for rapid replacement.

A reeling mechanism 2 transfers the fibre tow 1 to a nozzle 4 which is rotatable about the vertical axis 3 of the cutting apparatus. An injector element 5 supplied with compressed air through an inlet 6 is placed in front of the nozzle 4 to facilitate feeding of the fibre tow and reduce the friction against the wall. The rotatable nozzle 4 is curved so that its lower end 7 is placed with its longitudinal axis substantially horizontal, in front of the cutting wheel 8. The longitudinal axis of the lower end 7 of the nozzle should preferably be positioned so that the fibre tow 1 is as far as possible perpendicular to the plane passing through the axis 3 of the cutting wheel 8 and the axis of a first pressure roller 9 located immediatly behind the nozzle and passes substantially through the middle of a slot between a ring of cutting knives and the pressure roller. The cutting ring has replaceable knives 10 and is mounted on the shaft 11 and supported by, for example, a spring. Supporting discs 12,13 for pressure rollers 14 are provided above and below the cutting wheel 8 and are also rotatable about the axis 3. The distance between the axes of the pressure rollers 14 in the supporting discs 12,13 and the vertical axis 3 continuously decreases, starting from the pressure roller 9, so that the gap available for depositing the tow 1 on the cutting wheel 8 becomes progressively narrower. The supporting discs 12,13 must be balanced accordingly. The pressure rollers 14 roll on the fibre tow 1 which is wound round the cutting wheel. The depositing nozzle 4 and supporting discs 12,13 are driven by a belt and sprocket transmission 15, 16, 17. The sprocket wheel 17 is fixed to the supporting disc 12 by way of the clutch sleeve 18. This integrated drive unit is mounted on the stationary shaft 11 and 19. The pressure rollers 9, 14 mounted and supported at 20 are carried around the cutting wheel 8 by the rotating supporting discs 12, 13. The cut fibres drop through apertures 21, 22 in the ring of cutting knives and in the lower supporting discs 13 to collect in a collecting funnel 23.

The cutting wheel 8 need not necessarily be stationary. In one embodiment, it is suitably mounted so that it rotates in the opposite sense to the supporting discs and depositing nozzle, a higher take-off rate being thereby obtained. In another case, only the cutting wheel 8 rotates while the nozzle 4 and supporting discs 12, 13 remain at rest.

FIGS. 3 and 4 illustrate a special embodiment of the apparatus according to the invention, in which the pressure rollers are covered by an endless belt. This endless belt 24 is looped around the pressure rollers 14 so that the belt 24 is deflected from the inside to the outside around the roller in front of and the roller behind the lower end 7 of the depositing nozzle 4. The pressure rollers need not necessarily be driven. In the example illustrated in FIGS. 3 and 4, they are driven by a separately connected electric motor 25.

The pressure rollers may also be driven by the drive means 15, 16, 17 of the supporting discs 12, 13 by way of suitable pairs of gear wheels comprising a stationary wheel and a wheel which rolls off said stationary wheel and is fixed to the pressure roller 9.

In this example, the belt 24 rolls on the stationary cutting wheel 8, with the effect that no sliding friction is produced between the belt 24 and the fibre tow 1 which is to be cut. The supporting disc 12 must, of course, be equilibrated on account of the electric motor 25.

Figure 6:
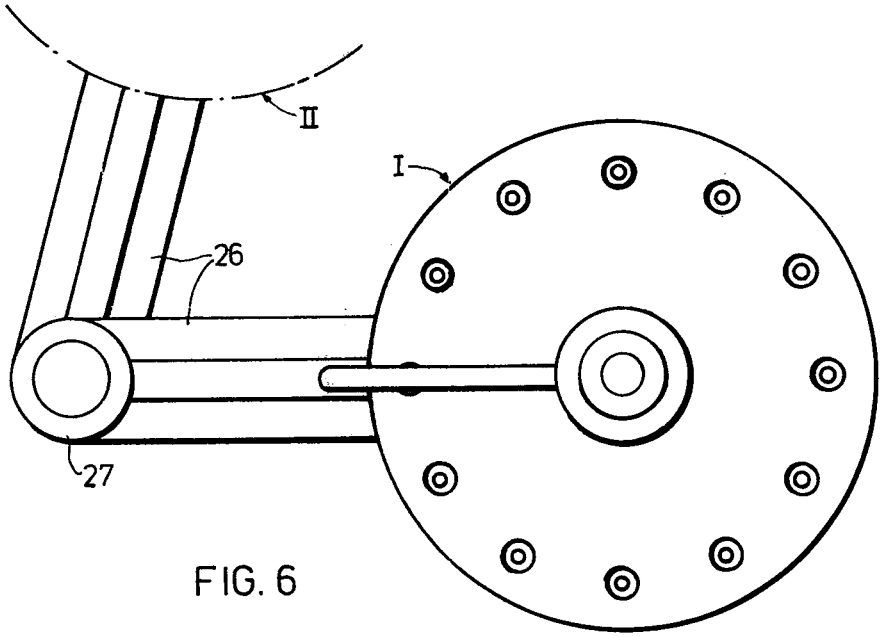
FIG. 6 is a corresponding elevational view of the change-blade cutting machine in four sectional planes.

FIGS. 5 and 6 show another variation of the apparatus according to the invention. Their specific feature lies in their design as an interchangeable cutting machine, which means that in the event of any technical faults on the cutting wheel or if the length of cut fibres requires to be changed, the cutting wheel including the nozzle, planet pressure rollers and receiver for cut fibres can in this case be very easily and quickly replaced by a fresh, completely assembled cutting wheel system. In this example, this is achieved by supporting the bearing shaft 11 on a cantilever arm 26 which is mounted at 27 to be rotatable about a support 28. In addition, the support 28 carries a drive motor 29. If the cutting wheel system requires to be changed, cutting system I resting on 26 can be rotated clockwise about support 28 until inlet aperture 30 of the nozzle of cutting wheel system II is situated under ejector opening 31 of the injector 5. The belt 16 is transferred from system I to system II while the apparatus is in an intermediate position so that the cutting wheel system II is available within a very short time. Periods of standstill are thereby virtually eliminated. One cutting wheel system can easily be serviced and repaired while the second system is in use.

What is claimed is:

1. Apparatus for the shredding of fibre tows into staple fibres comprising a cutting ring of substantially radially disposed blades disposed about a central axis and a plurality of pressure rollers disposed therearound and radially outwardly thereof, a feed device for the fibre tow to be cut and a container for receiving the staple fibres after cutting, means mounting the pressure rollers comprising supporting discs, one supporting disc mounted above and one below the cutting ring mounting each pressure roller around the ring for rotation about the central axis relative to the cutting ring, the feed device comprising a depositing nozzle mounted for rotation around the central axis relative to the cutting ring, means for synchronizing the relative rotation of the supporting discs and depositing nozzle and wherein the outlet of the depositing nozzle and pressure rollers are so arranged in relation to each other on the supporting discs that the nozzle outlet is always situated in a gap between two pressure rollers.

2. Apparatus according to claim 1, wherein the axes of the pressure rollers are disposed such that the gap between the cutting ring and the pressure rollers becomes progressively narrower, starting at the first pressure roller behind the gap for deposition of the tow and ending at the last pressure roller in front of the gap.

3. Apparatus according to claim 1 or 2, further comprising an endless belt looped around the pressure rollers and the deflection of the belt from the inside to the outside always takes place on the roller in front of and the roller behind the depositing nozzle.

4. Apparatus according to claim 1, further comprising a central drive system for driving the pressure rollers.

5. Apparatus according to claim 4, further comprising an electric motor attached to one supporting disc and rotatable therewith to drive the pressure rollers.

6. Apparatus according to claim 1, further comprising an auxiliary cutting ring and one switching device to alternatively put one or the other cutting ring into operation as required.

* * * * *